US008176671B2

(12) United States Patent
Pfersman et al.

(10) Patent No.: US 8,176,671 B2
(45) Date of Patent: May 15, 2012

(54) WEAPON BARREL AND DAMPING DEVICE

(75) Inventors: Axel Pfersman, Feucht (DE); Alfred Eckel, Röthenbach (DE); Kai Willner, Herzogenaurach (DE); Johannes Geisler, Nürnberg (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 120 days.

(21) Appl. No.: 12/276,529

(22) Filed: Nov. 24, 2008

(65) Prior Publication Data

US 2009/0133570 A1 May 28, 2009

(30) Foreign Application Priority Data

Nov. 23, 2007 (DE) ..... 10 2007 056 455

(51) Int. Cl.
*F41C 27/22* (2006.01)

(52) U.S. Cl. ..... 42/97

(58) Field of Classification Search ..... 42/97, 1.06, 42/76.01; 89/14.3, 14.05, 42.01, 42.02, 43.01, 89/44.01, 44.02
See application file for complete search history.

(56) References Cited

U.S. PATENT DOCUMENTS

| | | | | |
|---|---|---|---|---|
| 1,469,918 | A * | 10/1923 | De Maine | 89/43.01 |
| 2,075,087 | A * | 3/1937 | Birkigt | 89/37.19 |
| 2,381,130 | A * | 8/1945 | Lloyd | 89/1.1 |
| 3,191,330 | A | 6/1965 | Olsen | |
| 3,417,660 | A * | 12/1968 | Harbrecht | 89/198 |
| 4,211,146 | A * | 7/1980 | Bradley | 89/16 |
| 4,913,031 | A * | 4/1990 | Bossard et al. | 89/14.3 |
| 5,044,351 | A * | 9/1991 | Pfeifer | 124/89 |
| 5,423,145 | A * | 6/1995 | Nasset | 42/75.01 |
| 6,223,458 | B1 * | 5/2001 | Schwinkendorf et al. | 42/1.06 |
| 6,250,198 | B1 * | 6/2001 | Vendetti et al. | 89/44.02 |
| 6,745,663 | B2 * | 6/2004 | Ebersole et al. | 89/42.01 |
| 2007/0271833 | A1 * | 11/2007 | Fletcher | 42/97 |

FOREIGN PATENT DOCUMENTS

| | | |
|---|---|---|
| DE | 739 398 | 9/1943 |
| EP | 0 348 675 A1 | 1/1990 |

* cited by examiner

*Primary Examiner* — Michael Carone
*Assistant Examiner* — Reginald Tillman, Jr.
(74) *Attorney, Agent, or Firm* — Laurence A. Greenberg; Werner H. Stemer; Ralph E. Locher

(57) ABSTRACT

A weapon barrel of an automatic firearm is subject to bending oscillations during firing. A damping device is provided for damping the bending oscillations and to at least largely dissipate the kinetic energy of the bending oscillations by friction processes which are initiated by the bending oscillations, between two respective successive shots in the firing sequence.

25 Claims, 11 Drawing Sheets

WEAPON BARREL AND DAMPING DEVICE

CROSS-REFERENCE TO RELATED APPLICATION

This application claims the priority, under 35 U.S.C. §119, of German application DE 10 2007 056 455.6, filed Nov. 23, 2007; the prior application is herewith incorporated by reference in its entirety.

BACKGROUND OF THE INVENTION

Field of the Invention

The invention relates to a weapon barrel of an automatic firearm that is subject to bending oscillations during firing, and to a damping device for the damping of bending oscillations to which the weapon barrel of an automatic weapon is subject upon being fired.

When conventional automatic weapons are operated in the continuous-fire mode, the hit accuracy is considerably influenced by barrel bending oscillations which lead to undesirable scatter in the shot pattern. Although the problems associated with barrel bending oscillations in automatic weapons have already been known for a long time, no satisfactory solution has yet been found. Attempts have admittedly been made to cope with the problem by increasing the stiffness of the weapon barrel, for example by increasing the wall thickness of the weapon barrel. This has the disadvantage that it increases the weight of the weapon barrel, and therefore of the entire weapon system, out of all proportion. Furthermore, this measure also results in only a slight improvement in the hit pattern since only the amplitudes of the barrel bending oscillations are reduced, but the oscillations are not completely suppressed.

A further solution approach to the above problem, although this leads to virtually no improvement whatsoever in the hit pattern, will be explained with reference to FIGS. 6A and 6B of the drawings. That solution approach attempts to achieve an improvement in the shot pattern by clamping the weapon barrel and/or firmly mounting it. FIG. 6A shows such clamping in the forward third of the weapon barrel, in consequence resulting in an oscillation node. The muzzle end of the weapon barrel is, however, deflected in the radial direction as before, as illustrated by the double arrow S. Even if the weapon barrel is fixed or clamped directly adjacent to the barrel muzzle, as is illustrated in FIG. 6B, this does not overcome the problem because the oscillation nodes are then located at the barrel start and at the muzzle. The oscillation antinode which is then formed in the center of the weapon barrel during the oscillation process after a shot has been fired deflects the firing direction of the shot from the original, straight-ahead direction, despite the fixing at the muzzle end. The different firing directions of successive shots from the automatic weapon therefore result in scattering of the shot pattern, to a greater extent along the range to the target. Even additional clamping points just create new oscillation nodes which means, however, that in the end it is not possible to prevent the barrel bending oscillations which are responsible for the poor hit pattern.

SUMMARY OF THE INVENTION

It is accordingly an object of the invention to provide a damping system for a weapon barrel which overcomes the above-mentioned disadvantages of the heretofore-known devices and methods of this general type and which improves the hit pattern for automatic barrel weapons, and to reduce the scatter of the shot pattern.

With the foregoing and other objects in view there is provided, in accordance with the invention, a weapon barrel of an automatic firearm subject to bending oscillations during firing. The novel device comprises a damping device for damping the bending oscillations which is designed to at least largely dissipate a kinetic energy of the bending oscillations by way friction processes initiated by the bending oscillations, between two respective successive shots in a firing sequence.

The invention is in this case based on the concept that simply varying the barrel bending oscillations by provision of one or more clamping points does not solve the problem stated above, or solves it only inadequately. In fact, the present invention provides for the barrel bending oscillations caused by firing to be damped as completely as possible between the respective individual shots in a firing burst. This is because, if the weapon barrel returns to its rest position after the barrel bending oscillations have decayed before each shot, and is stationary in this rest position, the firing direction of all the shots is at least largely the same. In the end, this leads to the hit points of the projectiles on the target being very close to one another (i.e., the shot pattern is optimized).

According to the invention, this effect is achieved for a weapon barrel of an automatic firearm which carries out bending oscillations during firing by means of a damping device for damping the bending oscillations. In this case, the damping device is designed to at least largely dissipate the kinetic energy of the bending oscillations by friction processes which are initiated by the bending oscillations, between two respective successive shots in the firing sequence.

For the purposes of the present invention, the expression 'a firing sequence' means, in an entirely general form, the shot sequence of an automatic firearm. Furthermore, of course, the expression used in the original German text for the "firing sequence" also refers, in particular, to the frequency of the shot sequence, that is to say how many shots are fired per unit time (i.e., per minute) during operation of the automatic firearm.

Damping of the barrel bending oscillation (dissipation) such as this results in kinetic energy, specifically the oscillation energy of the barrel, being taken from the weapon system, in particular from the weapon barrel, and in the process being dissipated, that is to say converted, to thermal energy. Since the barrel bending oscillations are made to decay before each shot in the firing sequence, the barrel can return to the initial position, in which it was previously aimed in the direction of the target, before each shot in the firing sequence. This measure makes it possible to eliminate or at least reduce the firing disturbances, that is to say the direction errors and velocity components of the shot transversely with respect to the aiming direction, which errors or components are caused by radial deflection of barrel sections from the initial position when undamped barrel bending oscillations occur.

One interesting aspect of the damping which is provided by the present invention is that the kinetic energy of the bending oscillations is dissipated by friction processes which are initiated only by the bending oscillations themselves. This means that the friction processes and the damping associated with them occur only when the weapon barrel has been caused to carry out bending oscillations. In particular, this also means feedback between the strength of the damping and the strength of the barrel bending oscillations. In the end, this leads to optimized oscillation damping, as will be explained in more detail in the following text.

The damping device preferably has a friction element which makes friction contact with a radial projection on the weapon barrel such that, when radial deflection caused by the bending oscillations of at least a part of the weapon barrel takes place, one surface of the friction element rubs on one surface of the radial projection on the weapon barrel. The expression "radial" with regard to the radial projection on the weapon barrel should not be understood in a restrictive form in this context by implying that this projection on the weapon barrel has only a radial component. For example, this expression also covers projections or protrusions on the weapon barrel which have surfaces with a radial alignment which is more or less pronounced. The radial projection on the weapon barrel may be an integral component of the weapon barrel, although it is just as possible for this radial projection to be plugged on, welded on or fitted to the weapon barrel in any other manner. A radial alignment such as this of the projection on the weapon barrel together with suitable alignment of the surface of the friction element after bending oscillations occur results in a sliding friction process which counteracts the radial deflection movement of the weapon barrel part. This friction process dissipates the bending oscillations to heat.

The radial projection on the weapon barrel can be designed in many different ways, for example in the form of a pin, a wedge or a ring sector. The radial projection on the weapon barrel is, however, preferably in the form of a ring which guides the weapon barrel and is attached to the weapon barrel. Because of the rotational symmetry, the embodiment in the form of a ring is advantageous for assembly of the weapon barrel and of the damping device that is coupled to it.

The friction element is preferably arranged such that it remains largely stationary under the influence of the bending oscillations. This is advantageous because any movement capability of the friction element would result in weakening of the friction if the friction-linked radial projection on the weapon barrel were to "drive" the friction element, such that the friction element would also oscillate ineffectively without damping the bending oscillations. This high degree of immobility can be achieved by coupling the friction element to a solid part of the firearm and/or to its supporting apparatus or substructure. This coupling may be in the form of a firm, robust link between the friction element and the supporting apparatus, although it may also be in the form of a coupling by means of which only movement of the friction element radially with respect to the weapon barrel axis is at least largely suppressed, but axial movement of the friction element is possible.

In this case, the friction element is preferably likewise in the form of a ring which guides the weapon barrel and is not attached to the weapon barrel. This allows the friction element to move in the axial direction. It is also possible for the inside of the ring to be at a distance from the weapon barrel such that the weapon barrel does not strike the friction element, or strikes it only lightly, while its barrel bending oscillations are taking place.

The damping device preferably has a housing through which the weapon barrel passes and in which the annular friction element is guided. In this case, the guidance for the annular friction element is preferably designed such that the annular friction element can move with as little resistance as possible in the axial direction, for example by the annular friction element having a corresponding roller bearing, lubricant bearing and/or sliding bearing on the inside of the cylindrical housing. At the same time, the guidance and bearing for the annular friction element are preferably provided without any play, which means that movement of the annular friction element in the radial direction is largely suppressed.

It is advantageous for the housing to be arranged around the weapon barrel such that it does not touch the weapon barrel while the weapon barrel is carrying out bending oscillations. This ensures that the defined friction process between the annular projection on the weapon barrel and the annular friction element can take place without any disturbance.

The housing is preferably firmly connected to a solid part of the firearm and/or to its supporting apparatus or substructure. The interaction of the friction element coupling, as described above, with a solid part of the firearm and/or with its supporting apparatus or substructure makes it possible to ensure that the friction element is largely stationary, at least in the radial direction, under the influence of the bending oscillations. It is therefore possible for the friction element to remain largely stationary under the influence of the bending oscillations, so that the sliding friction process between the annular radial projection on the weapon barrel and the annular friction element results in effective damping of the bending oscillations.

According to one particularly advantageous embodiment of the present invention, the damping device has a pressing device for pressing the surface of the friction element against the surface of the radial projection. For the purposes of the present invention, a pressing device means any device which can result in a force acting between the friction element and the radial projection. The pressing device is able to adjust, to a predetermined fixed or variable extent, the normal force between the two surfaces that are in contact. Since the friction force is proportional to the normal force between the surface of the friction element and the surface of the radial projection, the strength of the damping can be adjusted by the strength of the pressing force.

In the simplest case, the pressing device comprises a spring. The pressing device can, however, just as well be formed by a hydraulic device or by a pneumatic device.

When a spring is used as the pressing device, it is advantageous for the spring to be supported on the housing and to press the annular friction element against the radial projection. As a result of the fixed connection, as described above, between the housing and a solid part of the firearm and/or its supporting apparatus or substructure, the slightly compressed spring can exert a resultant force between the friction element and the radial projection on the weapon barrel.

It is particularly advantageous if the force with which the pressing device presses the surface of the friction element against the surface of the radial projection on the weapon barrel varies over time between two successive shots. Since the pressing force, as described above, is proportional to the sliding friction force, a damping force which varies over time can be achieved by variation of the pressing force.

According to one preferred embodiment of the invention, a change in the pressing force can be produced by a recoil movement of the weapon barrel after a shot. By way of example, a recoil movement of the weapon barrel such as this occurs in so-called recoil loaders. However, the pressing force can just as well be varied by other processes, for example by processes which are directly linked to the firing of the automatic weapon or by processes which act on the pressing device from the exterior. For example, it is also possible to use the variable pressure of the shot gases in a gas-pressure loader to vary the pressing force. This means that the pressing force can be varied by pressure of combustion gases which occur on firing.

Furthermore, the pressing device can be coupled to a high-speed actuating element which is designed to vary the pressing force within a time interval which is considerably shorter than the time interval between two successive shots. An actuating element such as this can be used to vary the strength of the damping of the bending oscillations repeatedly between two successive shots. This makes it possible to produce a damping characteristic which can be predetermined virtually as required, and which can be applied to the damping device and in the end to the oscillating weapon barrel.

In this case, the actuating element is advantageously coupled to a measurement device for measuring the current bending oscillations, and the measured values of this measurement are used as the basis in real time to adjust the pressing force via the high-speed actuating element. This makes it possible to set the respectively optimum damping strength at any time as a function of the current strength of the bending oscillations. This optimum damping strength may, for example, be the maximum damping strength at which the surface of the friction element is just not yet clamped to the surface of the radial projection on the weapon barrel (see further below in this context). The application of this optimum or maximum damping force to the weapon barrel that is carrying out bending oscillations allows the barrel bending oscillations to be caused to decay within the shortest possible time. Conversely, this can in the end make it possible to increase the firing rate, that is to say the firing frequency, of the automatic firearm, provided that the time interval between two successive shots at the new firing rate is always still greater than or equal to this minimum damping time.

According to another embodiment of the fundamental idea of the present invention as explained initially, according to which a damping device for damping the bending oscillations is used for a weapon barrel of an automatic firearm and at least largely dissipates the kinetic energy of the bending oscillations by friction processes which are initiated by the bending oscillations, between two respective successive shots in the firing sequence, the damping device has a housing through which the weapon barrel passes, wherein a material agglomeration is incorporated in the area between the housing inner wall and the weapon barrel outer wall and is suitable for dissipation of oscillation energy of the bending oscillations to thermal energy.

This material agglomeration preferably comprises an agglomeration of metal balls. The use of metal balls has the advantage that they are highly resistant to temperature and are highly resistant to wear, and this is a major advantage in the case of the high forces and temperatures which occur on the weapon barrel of an automatic firearm.

In this case, it is possible either to completely fill the area between the housing inner wall and the weapon barrel outer wall with the metal balls so that the metal balls exert a certain amount of pressure on one another, or to fill the area only partially with the metal balls, so that they can at least largely move freely with respect to one another. Complete filling of the housing area with metal balls has the advantage that the metal balls are shaken by the barrel bending oscillations such that the effect of so-called micro-slip occurs, which ensures a particularly effective form of oscillation damping. In the case of micro-slip, the two elements which are in contact with one another (in this case the metal balls) can move only minimally with respect to one another. Amazingly, these micro-movements represent very effective friction processes which allow rapid dissipation of the initiating bending oscillations to thermal energy. However, the invention is not restricted to this embodiment with the housing internal area completely filled. It is just as possible to only partially fill the housing internal area with the metal balls, so that they can move freely with respect to one another. Depending on the configuration of the housing inner wall and the choice of material for the metal balls, this option can also contribute to an effective damping of the bending oscillations.

According to a further refinement of the invention, the material agglomeration comprises sand and/or a high-viscosity liquid and/or a gel. The two last-mentioned non-solid substances, in particular—used on their own or in combination with solids (for example with the metal balls described above)—can be used for effective dissipation of the kinetic energy of the bending oscillations to thermal energy. With the abovementioned non-solid material agglomerations—or else in the case of other media, such as the metal balls or the sand—it is preferably possible to seal the housing towards the barrel by a thin membrane, so that the medium cannot flow or pass out through the gap between the housing and the barrel outer wall. In this case, this membrane shall be designed such that the energy transfer from the weapon barrel to the dissipating medium is influenced as little as possible. It is therefore desirable for this membrane to be as thin/flexible as possible, and possibly also to be structured in a corrugated form. In addition, there is no need for a membrane such as this when using metal balls, provided that the diameter of the balls is larger than the gap between the housing and the barrel outer wall.

Furthermore, a compact, plastically or elastically deformable, material with high temperature resistance may also be used as the material agglomeration which is incorporated in the area between the housing inner wall and the weapon barrel outer wall. The choice of a material such as this has the advantage that it is easier to handle than non-solid materials or material agglomerations formed by small items, such as balls or sand.

For the reasons already mentioned above, it is also advantageous in this case for the housing to be arranged around the weapon barrel such that the housing remains largely stationary under the influence of the bending oscillations. It is accordingly also advantageous for the housing to be arranged around the weapon barrel such that it does not touch the weapon barrel while the weapon barrel is carrying out bending oscillations. In this context, it is also advantageous for the housing to be firmly connected to a solid part of the firearm and/or to its supporting apparatus or substructure.

In contrast to the stationary arrangement of the housing around the weapon barrel as described in the immediately preceding paragraph, it is, however, also possible to firmly connect the housing to the weapon barrel or to fit it to the weapon barrel at least such that it cannot slide. In this case, it is advantageous not to couple or to connect the housing to another part of the firearm. The damping effect of a damping device designed in this way may not be quite as effective as the damping device described above, but is easier to integrate in and retrofit to existing weapon systems.

All of the damping devices described above are preferably coupled to the weapon barrel such that the friction processes take place in and/or on the damping device.

The present invention also covers, of course, an automatic weapon having a weapon barrel having one of the damping devices described above.

The technical object of the present invention as described initially is also achieved by a damping device for damping of bending oscillations which are caused on the weapon barrel of an automatic weapon while it is being fired and which device can be coupled to the weapon barrel of the automatic weapon such that the kinetic energy of the bending oscillations can be at least largely dissipated by friction processes which are initiated by the bending oscillations, between two respective successive shots in the firing sequence.

For the reasons that have already been described above, it is also advantageous for the damping device according to the invention to comprise a friction element which can be friction-coupled to a radial projection on the weapon barrel such that, when radial deflection caused by the bending oscillations of at least a part of the weapon barrel takes place, one surface of the friction element rubs on one surface of the radial projection on the weapon barrel.

According to one advantageous refinement of the damping device according to the invention, the damping on this device can be varied in the time period between two successive shots. The expression "can be varied" means that the damping strength is varied automatically, without any further external action. By way of example, this is possible on the basis of processes which are related to the firing of the automatic weapon, such as the recoil movement of the weapon barrel in the case of a recoil loader or the pressure change in the combustion gases which are created when firing a gas-pressure loader.

However, it may also be advantageous for the damping to be able to be actively varied in the time period between two successive shots. This means that the damping strength is varied by coupling to external processes which take place outside of the original processes which are directly related to the firing of the automatic weapon. A high-speed actuating element may be used for such active variability in the case of the damping device according to the invention, which actuating element is designed to vary the damping within a time interval which is considerably shorter than the time interval between two successive shots. For example, the damping device may be designed to initially set the damping strength to a predetermined value directly after a shot, and then to set it to a lower value, or to the value zero, before the next shot.

According to one advantageous refinement of the damping device according to the invention described initially, this damping device may comprise a housing through which the weapon barrel can pass and which is sealed towards the weapon barrel outer wall by a thin membrane, wherein a material agglomeration is incorporated in the area between the housing inner wall and the membrane and is suitable for dissipation of oscillation energy of the bending oscillations to thermal energy.

In general, it is desirable for the purposes of the present invention for the damping to be as high as possible, in order that the barrel bending oscillations decay as quickly as possible. This is because, the more quickly it is possible to damp the oscillations, the higher the firing rate may be, that is to say the number of shots per unit time, since the barrel oscillations which are detrimental to the hit pattern are then dissipated within the shortened time interval between the shots.

When implemented in the embodiment as described above with a pressing device in the form of a spring, this means that the spring force with which the spring presses the annular friction element against the radial projection on the weapon barrel should be as high as possible because this then means that the friction force between the annular friction element and the radial projection (or the radial protrusion) will then also be greater, as will the damping. However, if this friction force is too great, there is a risk of the weapon barrel becoming jammed in a radially deflected position from the rest position, which will be counterproductive for the aim of the invention, specifically of improving the hit pattern. A compromise must therefore be found for constant damping, that is to say for a constant friction force which corresponds to constant preloading of the spring in the housing: the damping should be as high as possible in order to ensure that the barrel bending oscillations decay as quickly as possible, but at the same time should be as low as necessary to avoid jamming as far as possible.

According to the invention, this dilemma can be resolved by the use of damping which varies over time. The damping is advantageously relatively high directly after a shot when the amplitude of the barrel bending oscillations and therefore the oscillation energy thereof is at a maximum, and then decreases before the next shot. The damping characteristic, that is to say the damping force, friction force and the spring force, as a function of time, may in this case assume various forms. For example, a more or less "digital" damping characteristic is feasible, that is to say a change between a relatively high constant damping force and no damping force whatsoever (complete unloading of the spring). This can admittedly lead to jamming in the first phase after a shot, but this then occurs when the amplitude of the barrel bending oscillations has already decreased. In the absence of the damping force, the natural elasticity of the weapon barrel when its deflection is now greatly reduced means that it automatically returns relatively quickly to its rest position before the next shot takes place. This type of damping characteristic has the advantage that it can be implemented relatively easily. For example, the production of this damping characteristic can be directly coupled to the firing sequence of the automatic weapon. For example, in the case of a recoil loader, the recoil movement of the weapon barrel after a shot can be used to compress or to load the spring in the damping device in order in this way to achieve an increased friction force shortly after the shot between the annular friction element and the radial projection on the weapon barrel, and therefore an increased damping force. As soon as the barrel moves forwards again before the next shot, the spring is unloaded again and the damping is therefore decreased again. A corresponding solution can also be implemented for a vapour-pressure loader, to be precise by appropriate application of the combustion gases created on firing to a piston.

The self-coupling or self-controlling systems described above with their "digital" damping characteristic are distinguished by their simplicity and via their independence of other external control mechanisms for controlling the timing of the damping force. In some circumstances, however, it is also worthwhile in order to produce a technically/mathematically optimized damping characteristic, that is to say it is worth the effort, to provide an external control mechanism which sets the damping force to be as high as possible at any time, by means of a high-speed actuating element, so that jamming is just avoided between the annular friction element and the radial projection on the weapon barrel, and this would lead to optimally fast damping on the barrel bending oscillations. In this case, it will be possible to use a computer-controlled system which can use the high-speed actuating element—instead of the purely mechanical element in the form of a spring for example—to vary the pressing force of the annular friction element on the radial projection on the weapon barrel in a very short time. In order to optimize this pressing force, it is possible to measure the current barrel bending oscillations by means of a measurement element, and to use the measured values that result from this as the basis for adjustment of the pressing force via the high-speed actuating element, in real time.

The present invention in this case also covers corresponding software and a data processing program which is designed to control the processes as described above.

Other features which are considered as characteristic for the invention are set forth in the appended claims.

Although the invention is illustrated and described herein as embodied in weapon barrel and damping device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
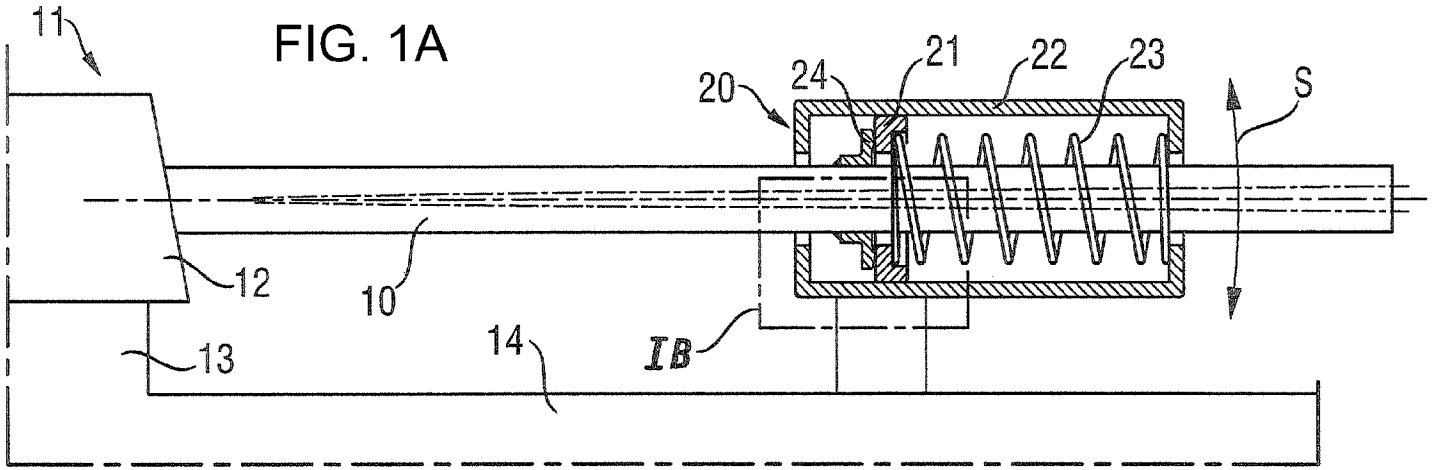
FIG. 1A is a partly sectional, diagrammatic side view of a first embodiment of the present invention.
Figure 1B:
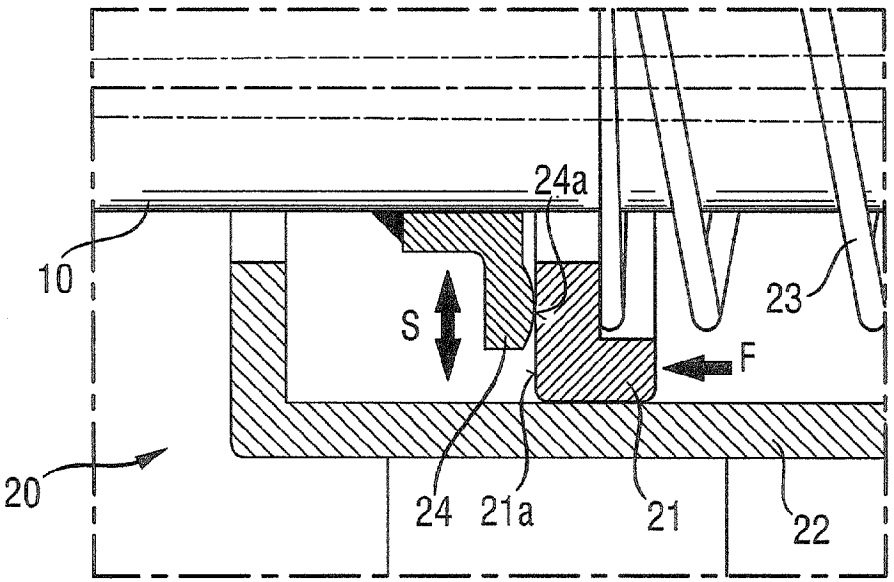
FIG. 1B is an enlarged detail from FIG. 1A.

Referring now to the figures of the drawing in detail and first, particularly, to FIGS. 1A and 1B thereof, there is shown a weapon barrel 10 of an automatic firearm 11 which is subject to bending oscillations S during firing. A damping device 20 is provided for damping the bending oscillations S and is designed to at least largely dissipate the kinetic energy of the bending oscillations S by friction processes which are initiated by the bending oscillations S, between two respective successive shots in the firing sequence. For this purpose, the damping device 20 has a friction element 21 which makes friction contact with a radial projection 24 on the weapon barrel 10. When radial deflection caused by the bending oscillations S of at least a part of the weapon barrel 10 takes place, one surface 21*a* of the friction element 21 rubs on one surface 24*a* of the radial projection 24 on the weapon barrel 10 (see FIG. 1B).

The radial projection 24 on the weapon barrel 10 is in the form of a ring which guides the weapon barrel 10 and is attached to the weapon barrel 10. For robustness reasons, this ring 24 in FIG. 1A is firmly connected via a cylindrical sleeve at an angle to the weapon barrel 10. The ring 24 and/or the cylindrical sleeve are/is preferably attached to the weapon barrel 10 by welding. In order to ensure that the ring 24 can be fitted and removed more easily, it may, however, also be firmly plugged on or clamped on. It is also feasible for the ring to be split in half in the radial direction with a hinge, such that the ring 24 can be placed around the weapon barrel 10 without having to pass it over the entire barrel. Once the two hinge halves of the ring 24 have been closed around the weapon barrel 10, the two hinge halves can be firmly connected to one another, so that the ring 24 is firmly seated on the weapon barrel 10.

The damping device 20 has a housing 22 through which the weapon barrel 10 passes and in which an annular friction element 21 is guided. The weapon barrel 10 is guided through the annular friction element 21. The annular friction element 21 is not attached to the weapon barrel 10. In fact, there is ideally sufficient play between the inside of the ring 21 and the outer wall of the weapon barrel 10 that the weapon barrel 10 does not touch the ring 21 while carrying out its bending oscillations S. The housing 22 is firmly connected to the substructure 14 of the firearm 11. It is also just as possible for the housing 22 to be firmly connected to a solid part 12 of the firearm 11 and/or to its supporting apparatus 13. The annular friction element 21 is fitted into the cylindrical housing 22 with as little play as possible between it and the housing inner wall. The thickness of the annular friction element 21 can preferably be chosen such that it can be guided through the housing inner wall without tilting. Since the housing 22 is firmly connected to the substructure 14 of the firearm 11, and there is no play between the outer edge of the ring 21 and the housing inner wall, the annular friction element 21 is in the end coupled to the substructure 14 which is not moved by the barrel bending oscillations of the weapon barrel 10, such that although the ring 21 can move largely without any resistance in the axial direction (ignoring the spring 23), the ring 21 can move as little as possible, however, in the radial direction. The ability of the ring 21 to move with as little friction as possible in the housing 22 can be achieved by means of an appropriate bearing, for example by the provision of a sliding bearing (with or without lubrication) or a ball bearing. In the end, the annular friction element 21 is therefore arranged such that it remains largely stationary in the radial direction under the influence of the bending oscillations.

The damping device 20 also comprises a pressing device 23 in the form of a spring. As can be seen in particular from FIG. 1B, the compressed spring 23 presses the surface 21*a* of the annular friction element 21 against the surface 24*a* of the radial projection 24 on the weapon barrel 10 with a specific force F. When the weapon barrel 10 now carries out bending oscillations S during firing, which deflect the weapon barrel 10 from its rest position in the radial direction, then the two surfaces 21*a* and 24*a* rub tangentially against one another. Depending on how large the force F is with which the spring 23 presses the surface 21*a* of the annular friction element 21 against the surface 24*a* of the annular radial projection 24 on the weapon barrel 10, the friction force between the two surfaces 21*a* and 24*a* will have a different magnitude. The friction force between the two surfaces 21*a* and 24*a* is directly proportional to the magnitude of the pressing force F. The greater the friction force between the two surfaces 21*a* and 24*a*, caused by the bending oscillations S, the greater in addition is the damping of the barrel bending oscillations S by the damping device 20. The spring 23 is supported at one end against the base of the cylindrical housing 22 and at the other end against the annular friction element 21.

It will be understood that the helical spring is but an exemplary implementation. Instead of the pressing device 23 being in the form of a spring, it is also possible for the pressing device 23 to be in the form of a hydraulic device or a pneumatic device.

The bending oscillations S which are detrimental to the hit pattern of the automatic firearm 11 can be dissipated quickly and effectively to heat by means of the friction (i.e., converted into heat), initiated by the bending oscillations S, between the annular radial projection 24 on the weapon barrel 10 and the annular friction element 21 on the damping device 20.

In addition, it is also feasible for the damping device 20 to be arranged such that it can move axially, via its firm connection to the substructure 14 of the firearm 11. For example, the foot via which the housing 22 of the damping device 20 is connected to the substructure 14 can be mounted in a rail in the substructure 14, running parallel under the weapon barrel 10. This allows the damping device 20 to be moved to any desired position on the weapon barrel 10. The foot can preferably be locked in or on the rail after being moved to a specific position. It may be advantageous to be able to move the damping device 20 along the weapon barrel 10 since the oscillation amplitudes of the barrel bending oscillations S vary over the length of the weapon barrel 10.

Figure 6A:
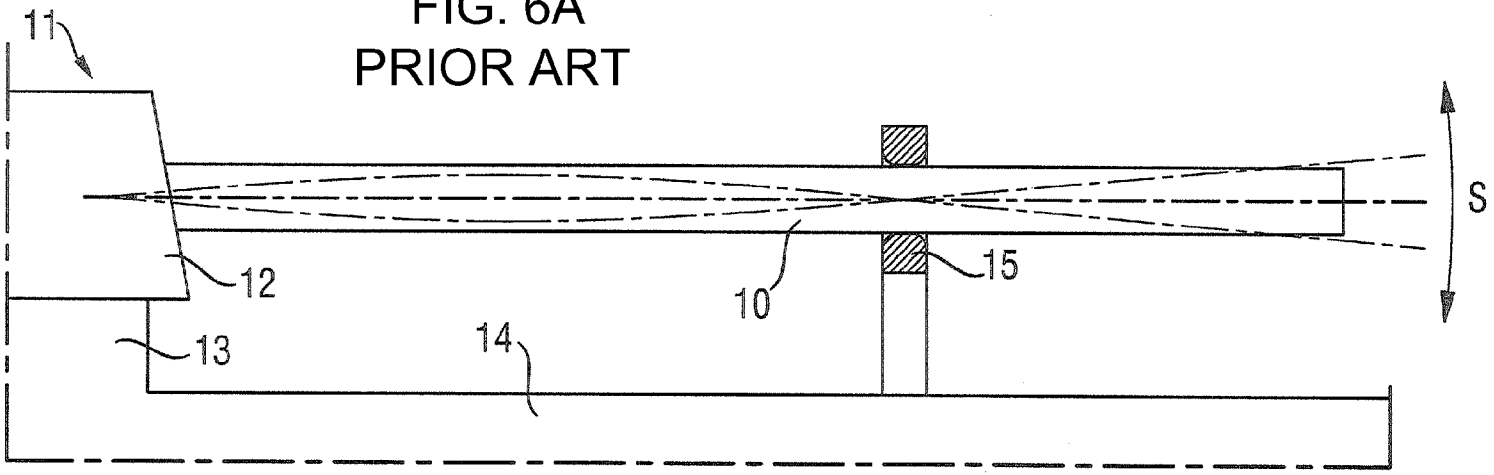
FIG. 6A PRIOR ART
FIGS. 6A and 6B are partly sectional, diagrammatic illustrations relating to the prior art, illustrating the formation of oscillation antinodes and oscillation nodes of the barrel bending oscillations as a function of different clamping positions.
Figure 6B:
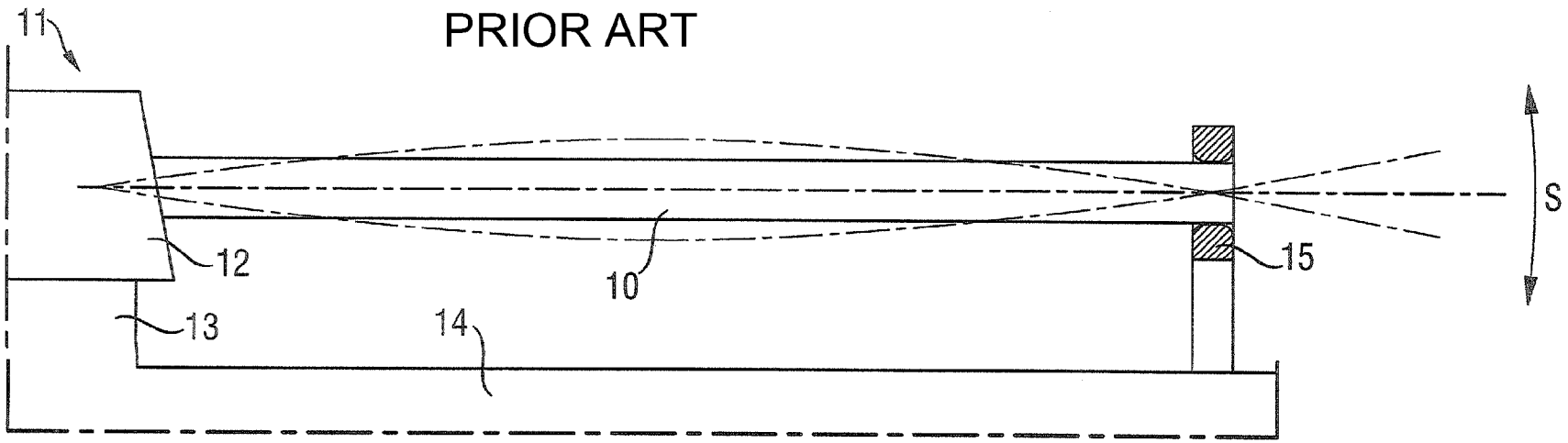
FIG. 6B PRIOR ART

It is also possible to combine the first embodiment of the invention, as described above, with fixed clamping points of the weapon barrel 10, as is known from the prior art shown in FIGS. 6A and 6B. Particularly in the case of a combination of features of FIG. 1A and FIG. 6B, it would in some circumstances be advantageous to move the damping device 20 to the center between the clamping point 15 and the barrel start, since this is where the oscillation amplitude of the barrel bending oscillations S is at a maximum (oscillation antinode).

Figure 5A:
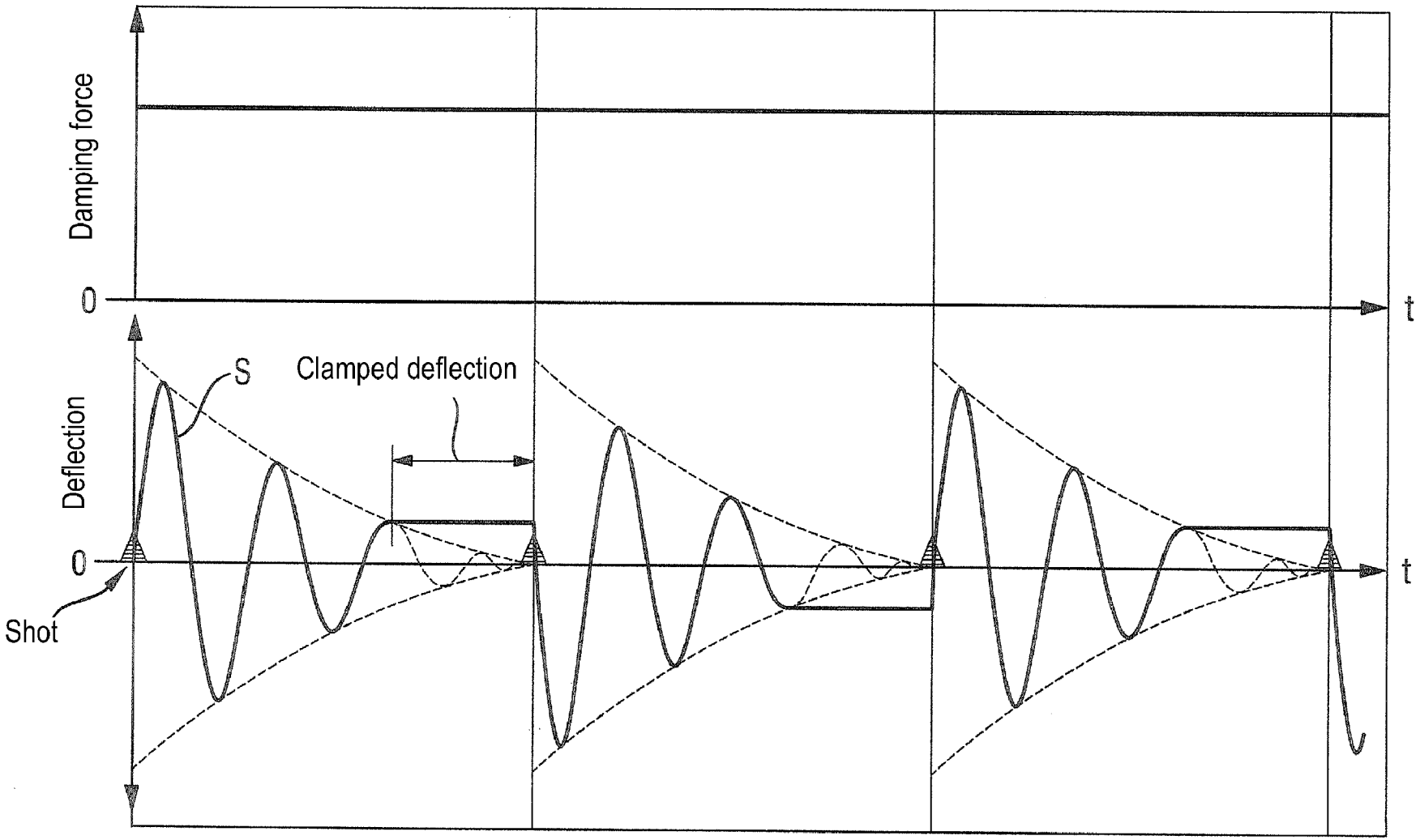
FIG. 5A is a graph showing the damping characteristic or oscillation characteristic of a weapon barrel damped with a constant damping strength for an automatic firearm which carries out bending oscillations during firing.

The first embodiment described above and as shown in FIGS. 1A and 1B can from certain points of view be linked to the oscillation characteristic or damping characteristic shown in FIG. 5A. This is because, as has already been explained further above, high damping is in general desirable in order to ensure that the barrel bending oscillations S decay as quickly as possible. This is because, the more quickly the oscillations S can be damped, the higher the firing rate may be, that is to say the number of shots per unit time, since the barrel oscillations S which are detrimental to the hit pattern are then dissipated even within the shortened time interval between the shots. With reference to the first embodiment as described above, this means that the spring force F with which the spring 23 presses the annular friction element 21 against the annular radial protrusion on the weapon barrel 10 should be as high as possible (that is to say as high a spring constant as possible) because this means that the friction force between the two surfaces 21*a* and 24*a* will then also be greater, as will the damping force. However, if the spring constant is too high and the friction force is in consequence too high there is a risk of the weapon barrel 10 becoming locked in the deflected position, after initially damped oscillations; that is, in a position in which it is radially deflected from the rest position (deflection 0 in FIG. 5A), and of the next shot being fired in this locked, deflected position. We shall refer to this locked deflection as a clamped deflection.

If the damping is constant, that is to say if the friction force is constant, corresponding to constant preloading of the spring 23 in the housing 22 on the damping device 20, a compromise must therefore be reached: on the one hand, the damping should be as high as possible (=spring constant as high as possible, that is to say "hard spring") in order to ensure that the barrel bending oscillations S decay as quickly as possible; however, on the other hand, the damping shall at the same time be as low as necessary (=spring constant as low as possible, that is to say "soft spring") in order as far as possible to avoid clamped deflections or to restrict this clamping to deflection values which are as low as possible.

In consequence, although the first embodiment of the invention as shown in FIGS. 1A and 1B in its own right makes a critical contribution to solving the technical problem, this first embodiment can be improved further.

The second embodiment of the present invention represents an improvement such as this of the first embodiment, as will be explained in the following text with reference to FIGS. 2A and 2B.

The improvement in the second embodiment consists mainly in that the damping can be varied in the time period between two successive shots. The damping is advantageously relatively high directly after a shot, when the amplitude of the barrel bending oscillations S and therefore their oscillation energy is at a maximum, and then decreases before the next shot. Such variability of the damping is achieved in the embodiment shown in FIG. 2A in a simple manner by using a recoil movement R of the weapon barrel 10, such as that which occurs in the case of a recoil loader, to more strongly compress the spring 23 of the damping device 20. The stronger compression of the spring 23 increases the pressing force F between the annular friction element 21 and the annular radial projection 24 on the weapon barrel 10. The friction between the surfaces 24*a* and 21*a* is therefore increased, in the end leading to a greater damping force.

Figure 2A:
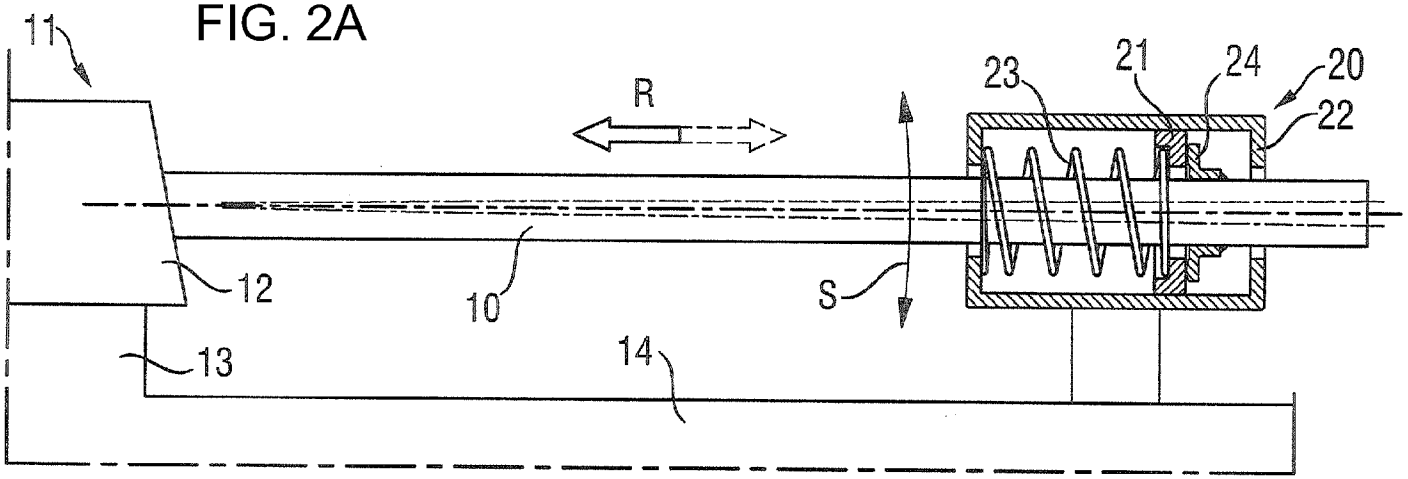
FIG. 2A is a partly sectional, diagrammatic side view of a second embodiment of the present invention.
Figure 2B:
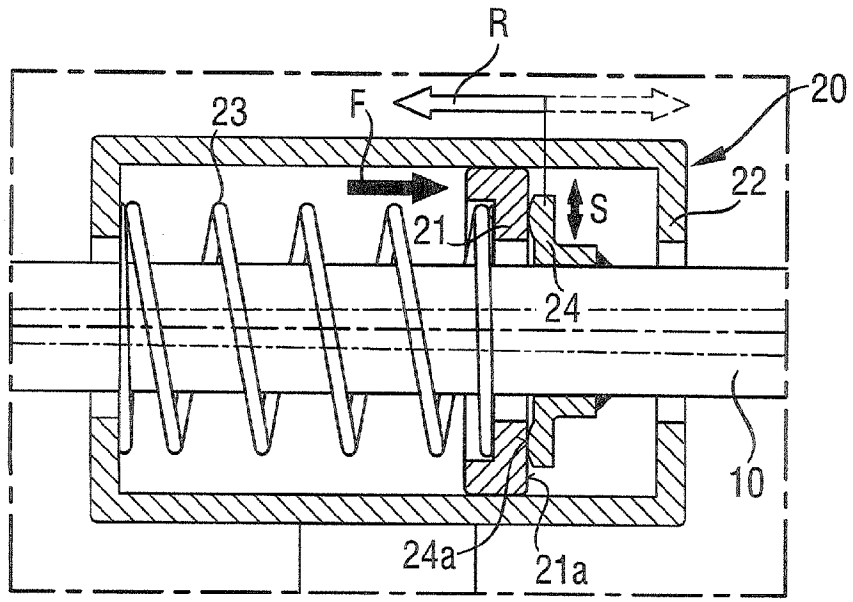
FIG. 2B is an enlarged detailed illustration of the right-hand part of FIG. 2A.

While, in the first embodiment, as shown in FIGS. 1A and 1B, the spring 23 is located behind the annular radial projection 24 on the weapon barrel 10 (that is to say closer to the muzzle than the projection 24), the spring 23 in the second embodiment as shown in FIGS. 2A and 2B is arranged in front of the radial projection 24 on the weapon barrel 10. This arrangement of the spring 23 in the second embodiment allows the radial projection 24, which is firmly connected to the weapon barrel 10, to drive the annular friction element 21 rearwards during the recoil movement R of the weapon barrel 10 and thus to compress the spring 23 to a greater extent. However, apart from this, the fundamental configuration of the second embodiment is the same as that in the first embodiment, and in addition the fundamental processes take place in precisely the same way as in the first embodiment. The explanations at this point will therefore refer to the wording of the first embodiment, in order to avoid repetition. In the second embodiment, the foot of the damping device 20 can therefore accordingly also be arranged on the substructure 14 such that it can move parallel under the weapon barrel 10. In addition, the second embodiment as shown in FIG. 2A can also be combined with fixed clamping points as shown in FIGS. 6A and 6B.

Figure 5B:
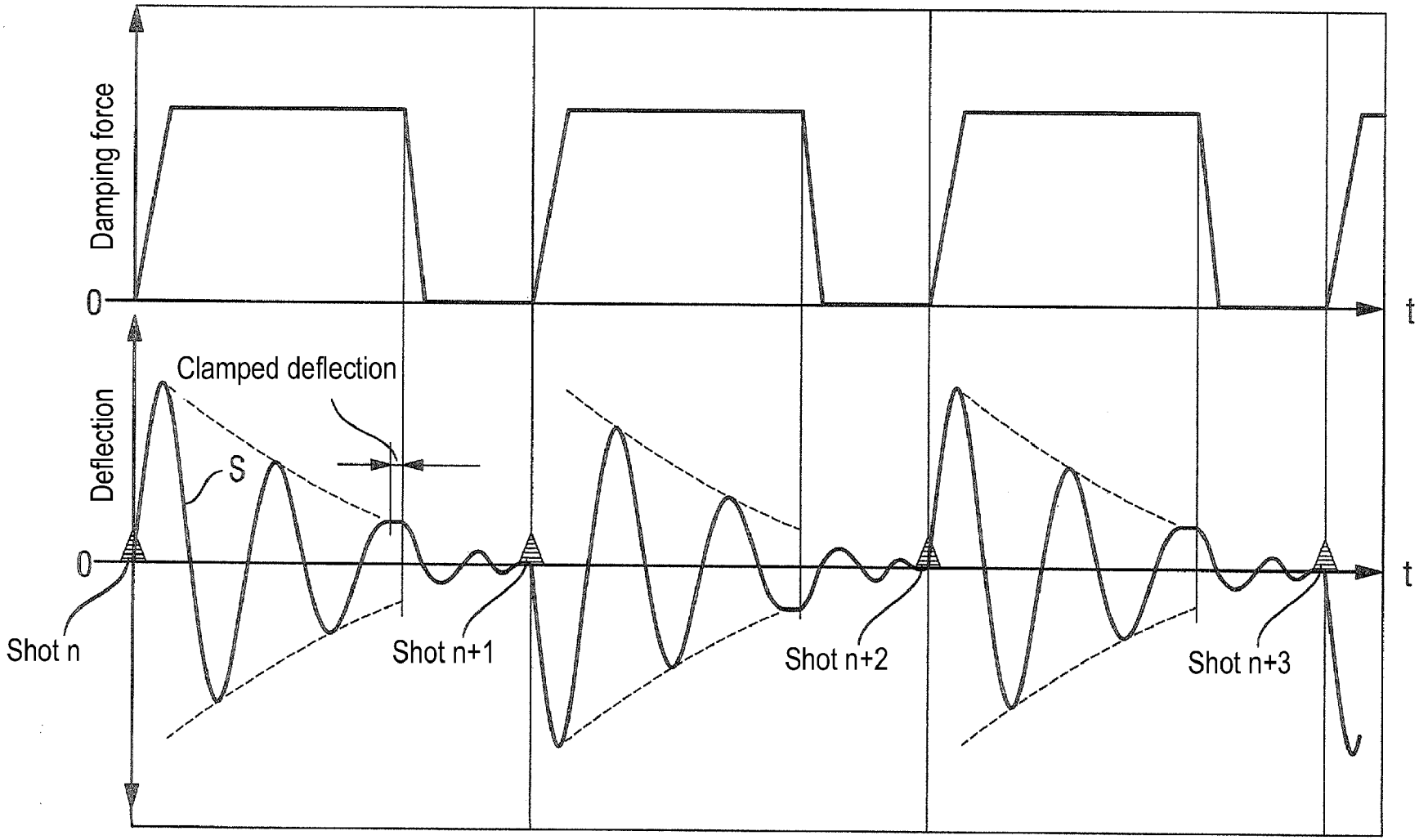
FIG. 5B is a graph showing the damping characteristic or oscillation characteristic of a weapon barrel of an automatic firearm which carries out bending oscillations during firing, with the damping strength being varied between the individual shots such that plateau phases of a specific constant damping force alternate with plateau phases without a damping force.
Figure 5C:
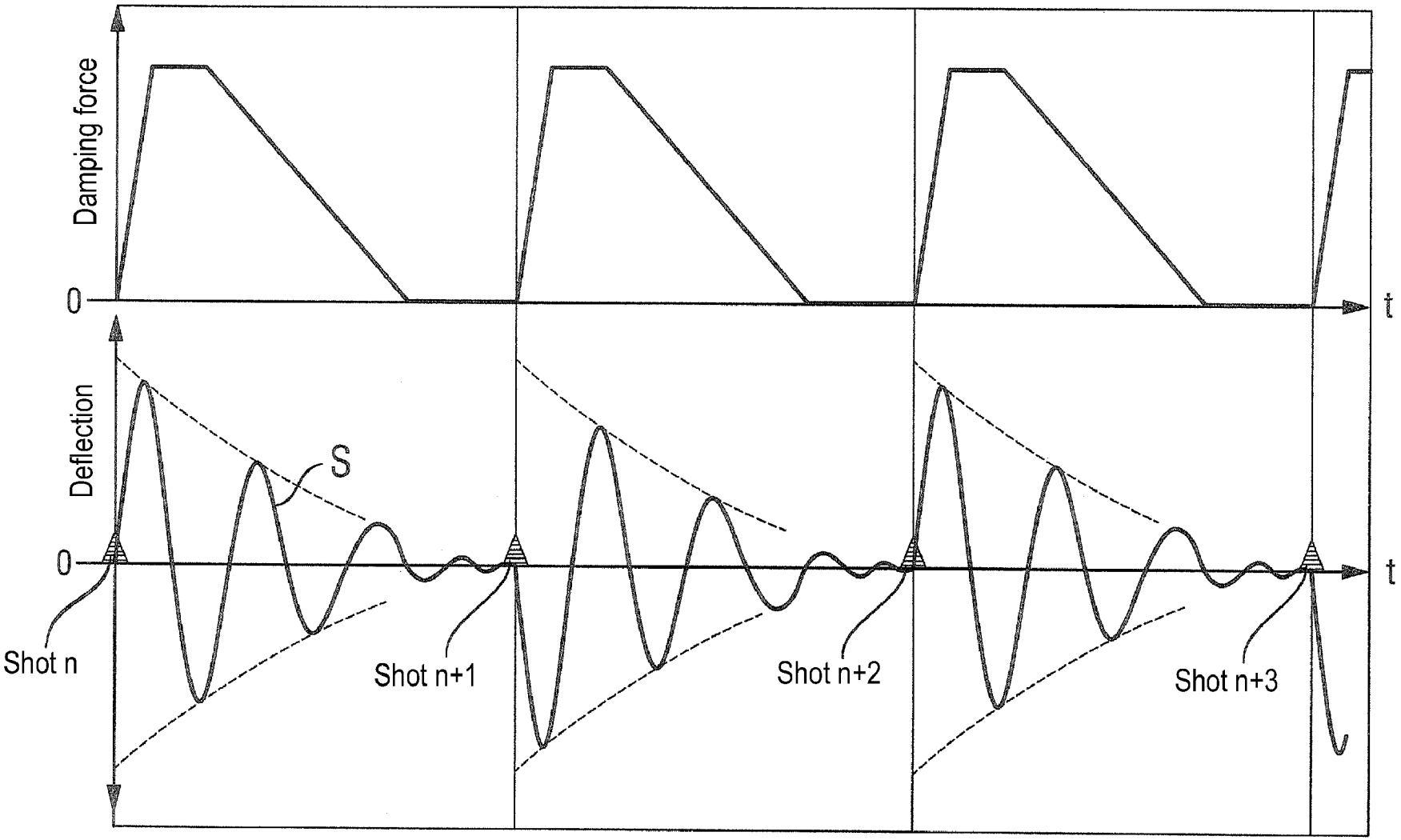
FIG. 5C is a graph showing the damping characteristic or oscillation characteristic of a weapon barrel of an automatic firearm which carries out bending oscillations during firing, with the damping characteristic being approximately triangular.
Figure 5D:
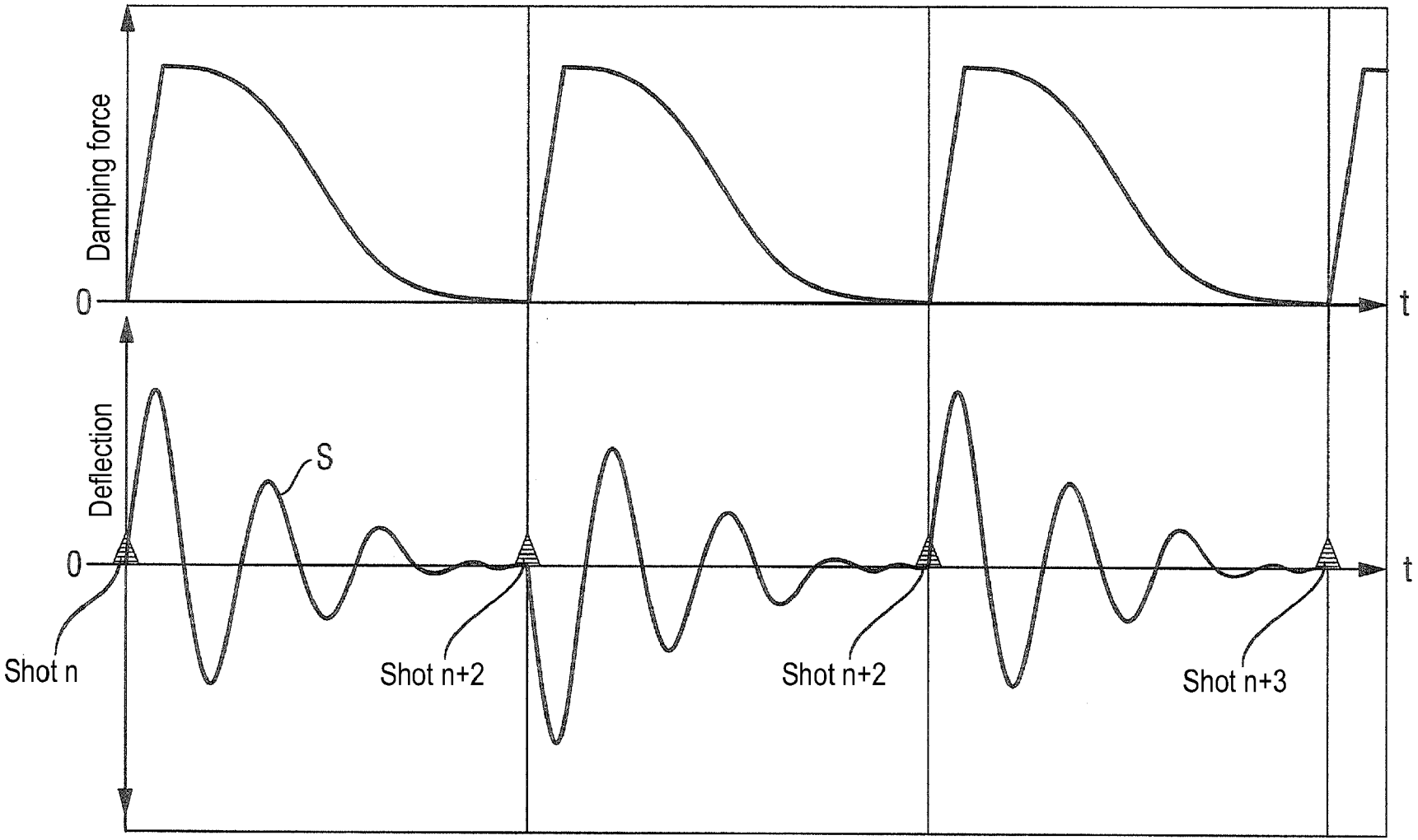
FIG. 5D is a graph showing the damping characteristic or oscillation characteristic in the second embodiment as illustrated in FIGS. 2A and 2B.

FIG. 5D shows the oscillation characteristic or damping characteristic associated with the second embodiment as shown in FIGS. 2A and 2B. As can be seen from the damping characteristic in the upper area of FIG. 5D, the damping force is zero or at least very low immediately before each shot is fired and when each shot is fired. This can be achieved, for example, by compressing the spring 23 in FIG. 2A only very slightly or not at all in the forward rest position of the weapon barrel 10, so that the annular friction element 21 is not pressed, or is pressed only very weakly, against the annular radial projection 24 on the weapon barrel 10. When the weapon barrel 10 now moves back to the rear after a shot has been fired, the spring 23 is compressed so that the pressing force F rapidly increases to a relatively high value. The latter is advantageous because the amplitude of the barrel bending oscillations S is at a maximum directly after the shot is fired. Since the oscillation energy in this early phase is at a maximum directly after the shot, the damping force can be very high without any problems without there being any risk of the weapon barrel 10 becoming jammed in the deflected position. The amplitude of the bending oscillations S is therefore reduced relatively quickly.

As the oscillation amplitude of the barrel bending oscillations S decreases, the damping force also advantageously decreases, in order to avoid the risk of jamming in a locked deflection with this reduced oscillation energy, as well. This reduction in the damping force advantageously takes place entirely automatically with the return movement (see the dashed arrow in FIGS. 2A and 2B) of the weapon barrel 10 forwards back to its initial position. The spring 23 can thus be unloaded from its relatively highly compressed state forwards in the direction of the muzzle again. At the same time, in consequence, the pressing force F, with which the spring 23 presses the annular friction element 21 against the radial annular projection 24 on the weapon barrel 10, is, of course, also reduced. The spring 23 is ideally completely unloaded again before the next shot, and the damping force will have fallen back to zero or to a very low value, so that there is no longer any risk of deflection locking.

The configuration of the second embodiment as shown in FIGS. 2A and 2B therefore results in an optimum damping force at all times in the interval between two successive shots, resulting in the deflections of the weapon barrel 10 caused by the bending oscillations S being reduced to zero or at least to a very low deflection value in a time which is as short as possible.

A third embodiment of the present invention will be explained in the following text with reference to FIGS. 3A and 3B.

According to this third embodiment, the damping device 20 has a housing 22 through which the weapon barrel 10 passes, wherein a material agglomeration 25 in the form of metal balls 25*a* is incorporated in the area between the housing inner wall and the weapon barrel outer wall. The metal balls 25*a* in the two FIGS. 3A and 3B are caused to move with respect to one another by the energy of the barrel bending oscillations S, resulting in the end in the oscillation energy of the bending oscillations S being dissipated to thermal energy.

Figure 3A:
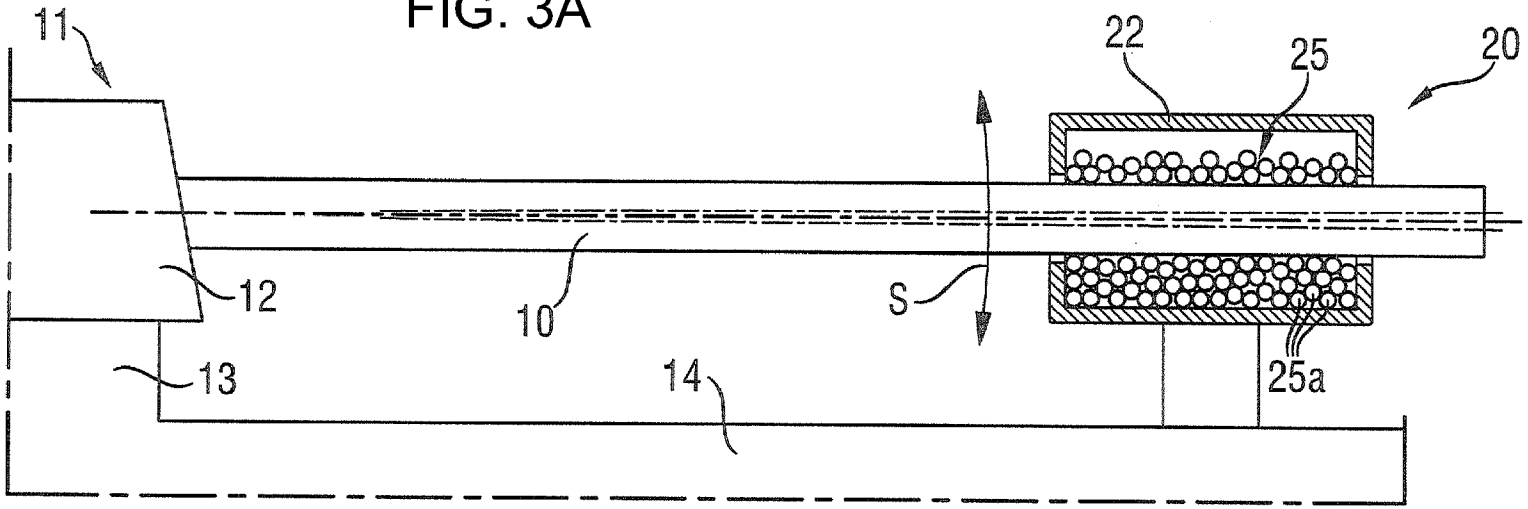
FIGS. 3A and 3B are partly sectional, diagrammatic side views of a third embodiment of the present invention.
Figure 3B:
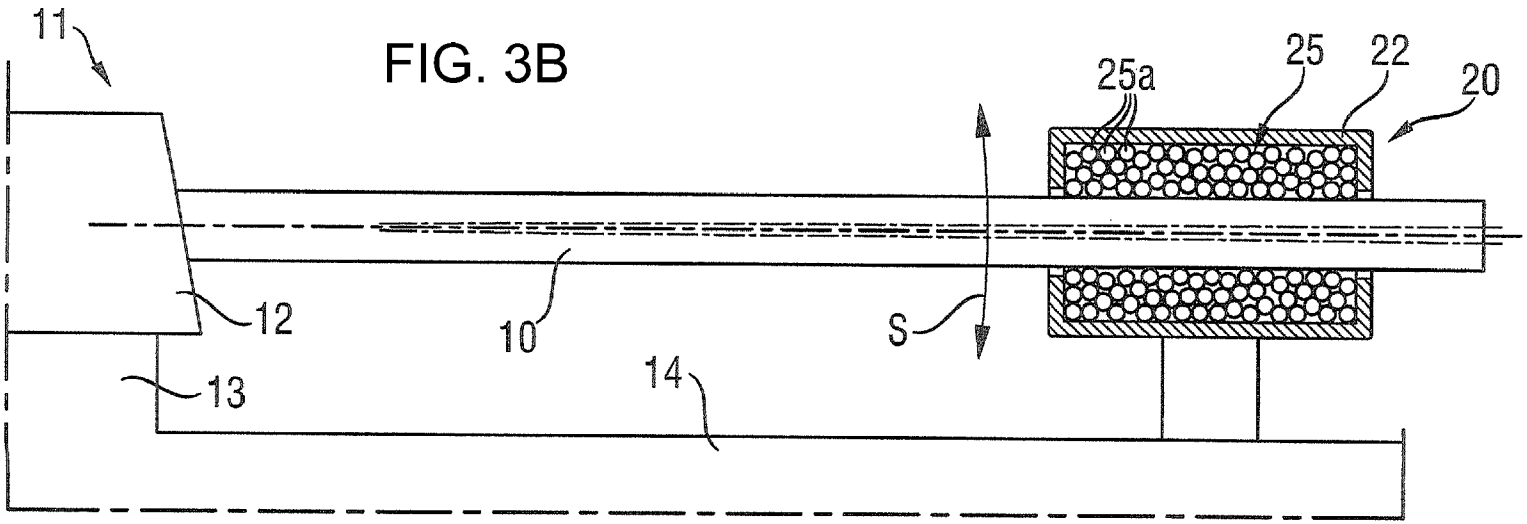

The respective preferences for partial filling of the housing 22 with metal balls 25*a* as shown in FIG. 3A and complete filling as shown in FIG. 3B have already been explained initially, and they will therefore not be explained again at this point.

Figure 3C:
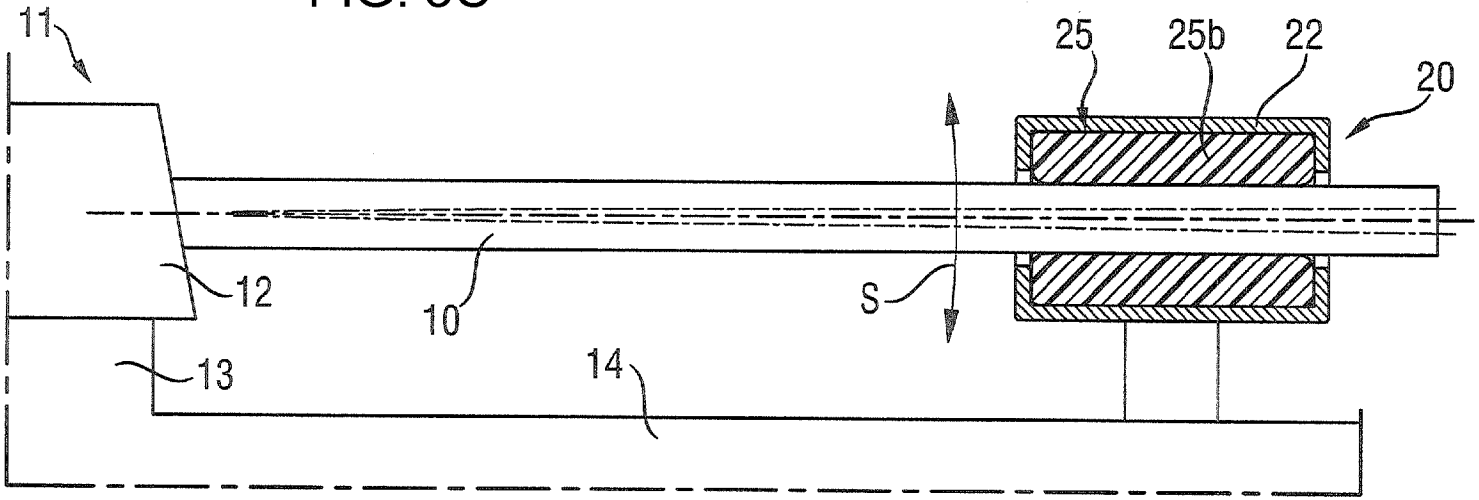
FIG. 3C is a similar view of a fourth embodiment of the present invention.

FIG. 3C shows a fourth embodiment of the present invention, in which the damping device 20 has a housing 22 through which the weapon barrel 10 passes, wherein a material agglomeration 25 in the form of a compact, plastically or elastically deformable, material 25*b* is incorporated in the area between the housing inner wall and the weapon barrel outer wall.

Figure 3D:
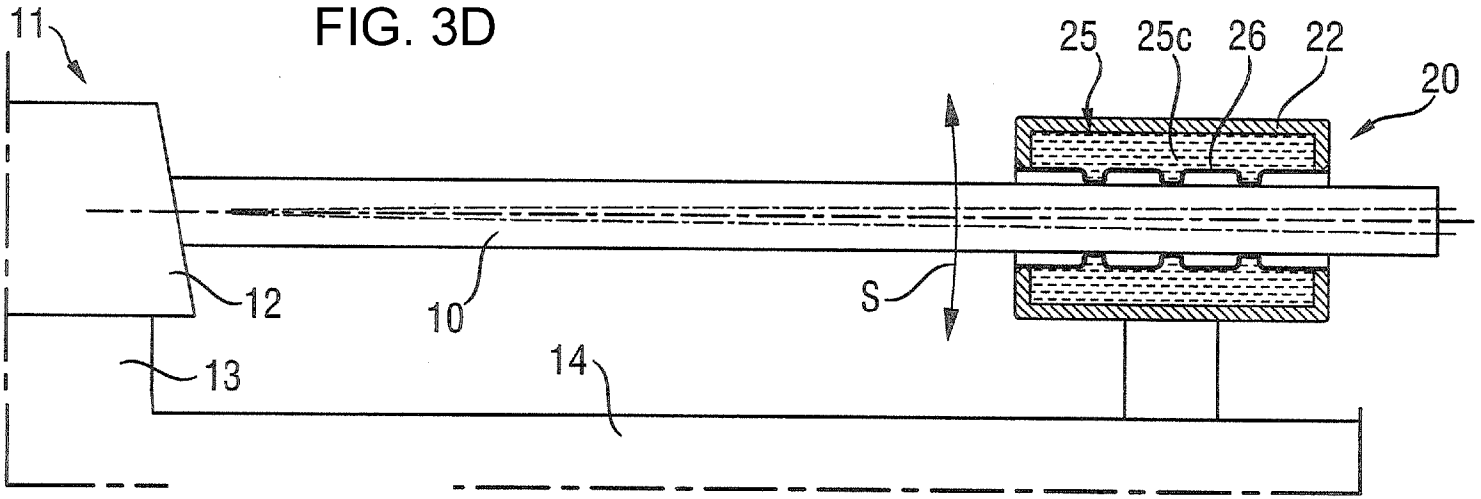
FIG. 3D is a similar view of a fifth embodiment of the present invention.

According to a fifth embodiment of the invention, as shown in FIG. 3D, the material agglomeration 25 comprises a high-viscosity liquid and/or a gel. The housing 22 is sealed towards the weapon barrel 10 by a thin membrane 26, so that the medium 25*c* cannot flow out through the gap between the housing 22 and the barrel outer wall. As can be seen from FIG. 3D, the membrane 26 is preferably structured such that it makes contact with the weapon barrel 10 at only a number of selected points. The oscillation energy of the bending oscillations S can be introduced into the high-viscosity medium 25*c* via the membrane at these points. The medium 25*c* allows the pressure fluctuations caused by this to propagate virtually instantaneously, and also, for example, to be reflected on the housing inner wall. By way of example, this could lead to deformations of the structured membrane 26 during the damping process, so that, in some circumstances, other parts of the membrane 26 (also) come into contact with the weapon barrel 10, than was initially the case. This also makes it possible to achieve an effective dissipation effect and therefore damping on the barrel bending oscillations S between two respective successive shots.

Figure 7:
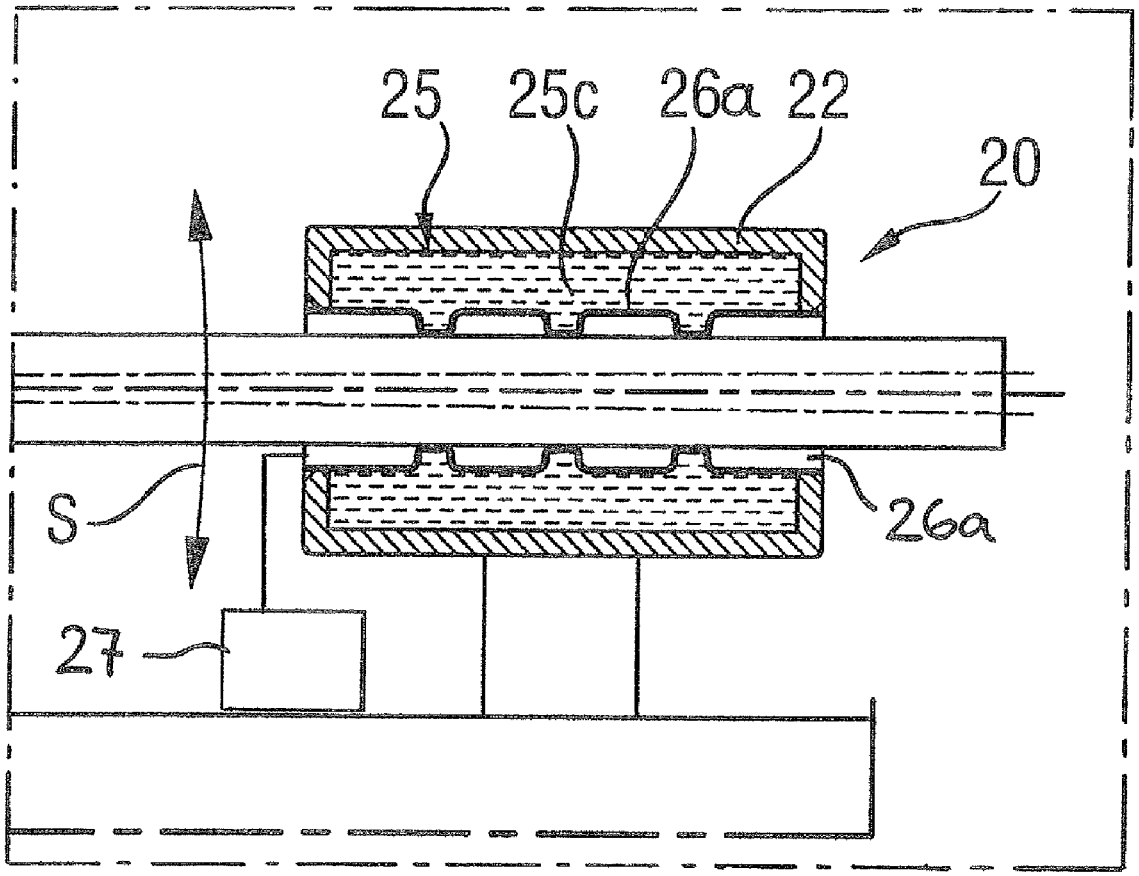
FIG. 7 is a diagrammatic view illustrating an alternative embodiment of the invention.

In accordance with an alternative embodiment of the inventive concept, there is provided a damping device that allows actively variable damping during the time period between two successive shots. For that purpose, a high-speed actuating element 26*a* that can be driven by way of a control unit 27 is provided for varying the damping force. In the illustration of FIG. 7, the high-speed actuating element 26*a* is a piezo element (here: four annular piezo stacks) inside the housing. As a voltage is injected into the piezo stacks, they expand and thus raise the pressure within the housing. The higher pressure in the chamber results in a higher damping force. The piezo element drive signal can be accurately adjusted to a variety of damping behaviors. For example, the variable damping may be set to initially have a predetermined high value immediately following a shot, and then to have a lower value prior to a next following shot. Any of the curves in FIGS. 5A-5D, or variations thereof, may be set. It will be understood, however, that the embodiment illustrated and described here is but an example of a high-speed actuating element for driving the variable damping behavior and that any of a plurality of alternative implementations may be selected. For example, the ring element 24 in FIG. 1*a* may be replaced by a driven actuating element, such as a piezo element.

Figure 4A:
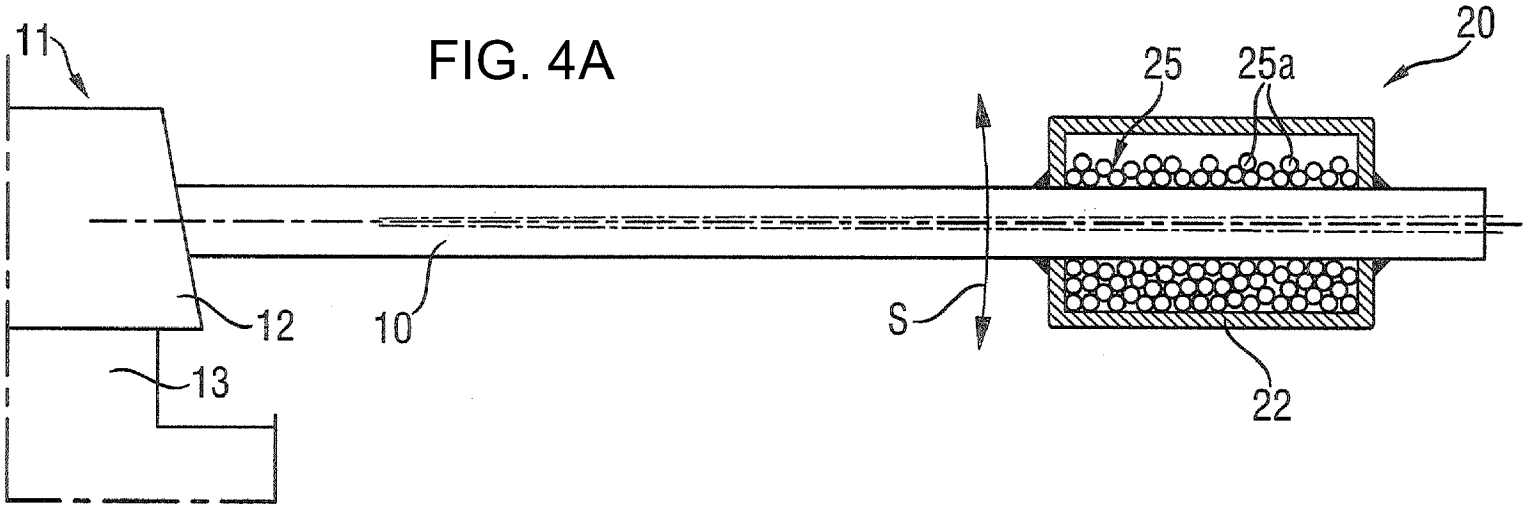
FIGS. 4A and 4B are similar views of a sixth embodiment of the present invention.
Figure 4B:
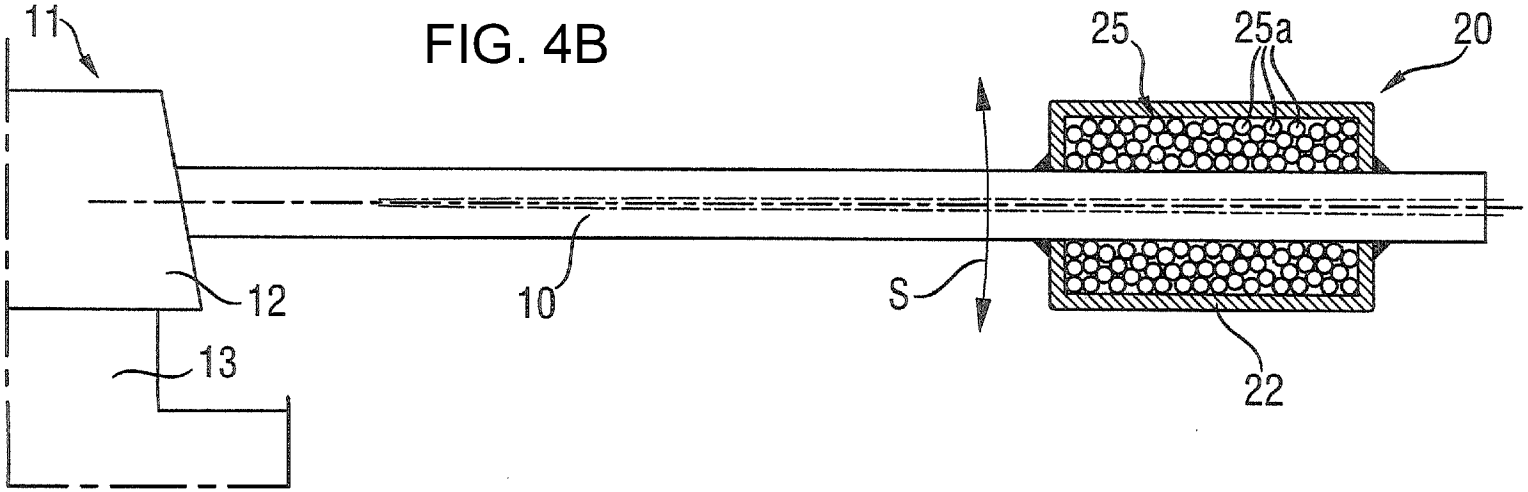

The sixth embodiment of the present invention, as is illustrated in FIGS. 4A and 4B, is similar to a certain extent to the third embodiment, as is illustrated in FIGS. 3A and 3B. However, in contrast to the third embodiment, the housing 22 in the sixth embodiment of the damping device 20 is firmly connected to the weapon barrel 10. Furthermore, the housing 22 is not connected to any other part 11, 12, 13 of the firearm. Reference should be made to the statements relating to the third embodiment with regard to the method of operation of the damping device according to this sixth embodiment.

As has already been described in detail above, one sub-aspect of the present invention is to provide for the barrel bending oscillations S of a weapon barrel 10 of an automatic firearm 11 to be damped in a manner which is varied or can be varied over time. The oscillation and damping characteristic shown in FIG. 5D has been analyzed in conjunction with the explanatory notes relating to the second embodiment as shown in FIGS. 2A and 2B. It should be understood that the present invention is not restricted to this oscillation and damping characteristic, even though this is to a certain extent optimal. Any other desired damping characteristics can also be used, as is illustrated by way of example in FIGS. 5B and 5C. For example, as is illustrated in FIG. 5B, the damping characteristic may have a relatively long plateau with a constant damping force, which falls to a damping force equal to zero or at least to a very low damping force, some time before the next shot. In this situation, there is admittedly a risk of locking the deflection when the oscillation amplitudes become less at the end of the plateau phase with a constant high damping force, but this jamming will be released by the damping force falling at the appropriate time to zero some time before the next shot, so that the oscillation of the weapon barrel 10, which is then only still very small, can easily decay in its own right once the jamming has been released.

FIG. 5C shows a further example of a possible damping characteristic with a relatively short plateau phase with a constant damping force, which is followed by a phase with a linearly decreasing damping force. In this case as well, any jamming which could still occur in some circumstances despite the decrease in the damping force can once again also be released in the last phase before the next shot, and any remaining amplitude can decay in its own right with a damping force equal to zero or with a very low damping force.

The upper part of FIGS. 5A, 5B, 5C and 5D in each case shows the damping force as a function of the time t. The deflection of the weapon barrel 10 from its rest position, i.e., the position of repose, is in each case plotted underneath this. The shots n, n+1, n+2, n+3 which are illustrated as small triangles represent the immediately successive shots in time at the firing rate of the automatic firearm 11.

It is thus possible with the aid of the invention as described in detail above to improve the hit pattern of an automatic barrel weapon, or tube weapon, and to reduce the scatter of the shot pattern. The main aspect of the present invention is in this case to damp as completely as possible the barrel bending oscillations S in each case caused by firing between the individual shots of a firing burst of the automatic weapon. This has not been possible until now by firmly clamping the weapon barrel 10 at specific holding points, as is illustrated in FIGS. 6A and 6B. This is because each of the clamping points just caused the formation of new oscillation nodes, as a result of which however, in the end, it was not possible to prevent the barrel bending oscillations S responsible for the poor hit pattern.

The invention claimed is:

1. A weapon barrel of an automatic firearm subject to bending oscillations during firing, comprising:

a damping device for damping the bending oscillations which is designed to at least largely dissipate a kinetic energy of the bending oscillations by way friction processes initiated by the bending oscillations, between two respective successive shots in a firing sequence, said damping device being disposed at a muzzle end of the weapon barrel, said damping device including a friction element mounted for making friction contact with a radial projection on the weapon barrel, said damping device including a pressing device for pressing said surface of said friction element against said surface of said radial projection, said friction element being mounted to remain substantially stationary under an influence of the bending oscillations, and a radial deflection due to the bending oscillations of at least a part of the weapon barrel causing a surface of said friction element to rub on a surface of said radial projection on the weapon barrel.

2. The weapon barrel according to claim 1, wherein said radial projection on the weapon barrel is a ring through which the weapon barrel extends, and said ring is attached to the weapon barrel.

3. The weapon barrel according to claim 1, wherein the weapon barrel is mounted to a firearm and said friction element is coupled to at least one of a solid part of the firearm and a supporting apparatus or substructure thereof.

4. The weapon barrel according to claim 3, wherein said friction element is a ring through which the weapon barrel extends and said ring is substantially not attached to the weapon barrel.

5. The weapon barrel according to claim 4, wherein said damping device includes a housing, the weapon barrel passes through said housing, and said friction element is guided in said housing.

6. The weapon barrel according to claim 5, wherein said housing is disposed around the weapon barrel and configured not to touch the weapon barrel while the weapon barrel is carrying out bending oscillations.

7. The weapon barrel according to claim 6, wherein the weapon barrel is mounted to a firearm and said housing is firmly connected to at least one of a solid part of the firearm and to a supporting apparatus or substructure thereof.

8. The weapon barrel according to claim 1, wherein said pressing device is a spring.

9. The weapon barrel according to claim 1, wherein said pressing device is configured to press said surface of said friction element against said surface of said radial projection with a force that varies over time between two successive shots.

10. The weapon barrel according to claim 9, wherein said pressing device is disposed such that a change in the pressing force is caused by a recoil movement of the weapon barrel after a shot.

11. The weapon barrel according to claim 1, wherein said damping device comprises a housing and the weapon barrel passes through said housing, and wherein a material agglomeration is incorporated inside said housing between a housing inner wall and an outer wall of the weapon barrel outer and configured to dissipate oscillation energy of the bending oscillations to thermal energy.

12. The weapon barrel according to claim 11, wherein said material agglomeration comprises an agglomeration of metal balls.

13. The weapon barrel according to claim 11, wherein said material agglomeration comprises at least one of the materials selected from the group consisting of sand, high-viscosity liquid, and gel.

14. The weapon barrel according to claim 11, which comprises a thin membrane sealing said housing towards an outer wall of the weapon barrel.

15. The weapon barrel according to claim 11, wherein said material agglomeration comprises a compact, plastically or elastically deformable, material with high temperature resistance.

16. The weapon barrel according to claim 11, wherein said weapon barrel is mounted to a firearm and said housing is firmly connected to at least one of a solid part of the firearm and a supporting apparatus or substructure thereof.

17. The weapon barrel according to claim 11, wherein said weapon barrel is mounted to a firearm, said housing is firmly connected to the weapon barrel or fitted to the weapon barrel such that said housing cannot slide, and said housing is not coupled or connected to any other part of the firearm.

18. An automatic weapon, comprising the weapon barrel according to claim 1.

19. A damping assembly for damping bending oscillations of a weapon barrel of an automatic weapon being fired in a successive firing sequence, comprising:

a damping device coupled to the weapon barrel of the automatic weapon, said damping device being disposed at a muzzle end of the weapon barrel, and said damping device being configured to dissipate a kinetic energy of the bending oscillations by friction processes, initiated by the bending oscillations, between two respective successive shots in the firing sequence; and a friction element disposed for friction-coupling with a radial projection on the weapon barrel, when at least a part of the weapon barrel is radially deflected due to the bending oscillations, a surface of said friction element rubs against a surface of said radial projection on the weapon barrel, said damping device including a pressing device for pressing said surface of said friction element against said surface of said radial projection, said friction element being mounted to remain substantially stationary under an influence of the bending oscillations.

20. The damping assembly according to claim 19, wherein said damping device is configured to allow a damping to be actively varied in a time period between two successive shots.

21. The damping assembly according to claim 20, which comprises a high-speed actuating element configured to vary a damping force within a time interval that is considerably shorter than a time interval between two successive shots.

22. The damping assembly according to claim 19, wherein the damping is set to initially have a predetermined value immediately following a shot, and then to have a lower value prior to a next following shot.

23. The damping assembly according to claim 22, wherein the variable damping is set to have a value zero just prior to the next following shot.

24. The damping assembly according to claim 19, wherein said damping device comprises a housing through which the weapon barrel pass and which is sealed towards an outer wall of the weapon barrel by a thin membrane, and wherein a material agglomeration is incorporated in a space between an inner wall of said housing and said membrane and configured to dissipate oscillation energy of the bending oscillations to thermal energy.

25. The damping assembly according to claim 19, wherein said damping device is configured for variable damping in a time period between two successive shots.

* * * * *